US007112773B2

(12) United States Patent
Thompson

(10) Patent No.: US 7,112,773 B2
(45) Date of Patent: Sep. 26, 2006

(54) BLEEDER POWERED GATING AMPLIFIER

(75) Inventor: Robert C. Thompson, Lancaster, PA (US)

(73) Assignee: Burle Technologies, Inc., Wilmington, DE (US)

( * ) Notice: Subject to any disclaimer, the term of this patent is extended or adjusted under 35 U.S.C. 154(b) by 57 days.

(21) Appl. No.: 10/925,334

(22) Filed: Aug. 24, 2004

(65) Prior Publication Data

US 2006/0043259 A1 Mar. 2, 2006

(51) Int. Cl.
*H01J 40/14* (2006.01)

(52) U.S. Cl. ..... 250/207; 250/214 VT

(58) Field of Classification Search ..... 250/207, 250/214 VT; 313/103 CM
See application file for complete search history.

(56) References Cited

U.S. PATENT DOCUMENTS 5,051,572 A * 9/1991 Joseph et al. ..... 250/207

OTHER PUBLICATIONS

J.R. Herman et al., "Normally on photomultiplier gating circuit with reduced post-gate artifacts for use in transient luminescence measurements," Rev. Sci. Instrum. 63(11), pp. 5454-5458, Nov. 1992.

D.G. Jameson et al., "A nanosecond gating circuit for use with a photomultiplier with a focus electrode," Journal of Physics E: Scientific Instruments, vol. 8, pp. 635-636, (1975).

T.M. Yoshida, "A high-speed photomultiplier gating circuit for luminescence measurements," Rev. Sci. Instrum. 60(9), pp. 2924-2928, Sep. 1989.

T.D.S. Hamilton, "Variable duration photomultiplier gating circuit," J. Phys. E: Scientific Instruments, vol. 4, pp. 326-327, (1971).

M. Bruce Schulman, "Gating circuit for linear-focused photomultiplier," Rev. Sci. Instrum. 60(7), pp. 1264-1266, Jul. 1989.

B. George Barisas et al., "Grid-gated photomultiplier photometer with subnanosecond time response," Rev. Sci. Instrum. 51(1), pp. 74-78, Jan. 1980.

D.J. Creasey et al., "A fast photomultiplier tube gating system for photon counting applications," Rev. Sci. Instrum., vol. 69, No. 12 (1998).

Vishay Intertechnoogy, Inc., Technical Data Sheet for N-Channel 60-V (D-S) MOSFET.

SGS-Thomson Microelectronics Technical Data Sheet for HCC/HCF40109B Quad Low-To-High Volgate Level Shifter.

Photek Technical Note 98G for PMT Grating.

Hamamatsu Photonics K.K. Technical Data Sheet for H7680/-01 Gated PMT Modules.

* cited by examiner

*Primary Examiner*—Thanh X. Luu
(74) *Attorney, Agent, or Firm*—Dann, Dorfman, Herrell and Skillman, P.C.

(57) ABSTRACT

A gating circuit switches the responsivity of a photomultiplier tube between ON and OFF states by modulating the voltage bias of the one or more of its electrodes. The gating circuit capacitively couples a voltage pulse to the photocathode or other electrode of the photomultiplier tube in response to a low-voltage gating triggering signal. The voltage divider network and high-voltage power supply used to statically bias the photomultiplier tube also power the gating circuitry and source the gating voltage pulse, thus circumventing the need for a separate high-voltage power supply. The gating circuit represents a near-inconsequential burden on the power supply, as it draws practically negligible current from the voltage divider network. The electrode gating pulse characteristics, including rise- and fall-times, voltage swing amplitude and duration, can be modified by adjusting resistor and capacitor values and Zener diode characteristics of the gating circuit and voltage divider network. The circuit can also be used to gate related devices such as microchannel plates and image intensifiers.

18 Claims, 10 Drawing Sheets

BLEEDER POWERED GATING AMPLIFIER

FIELD OF INVENTION

The invention relates to electronic circuitry used to control photomultiplier tubes and similar devices. More specifically, the invention concerns circuits that can be used to 'gate' or electronically switch photomultiplier tubes, microchannel plates, image tubes, and image intensifiers between a responsive ON state and non-responsive OFF state.

BACKGROUND OF THE INVENTION

Photomultiplier tubes are radiation detectors employed in diverse applications including spectroscopy, astronomy, biotechnology, remote sensing, medical imaging, nuclear physics, and laser ranging and detection. Photomultiplier tubes exhibit excellent sensitivity, high gain, and low-noise characteristics, and further, photomultiplier tubes with relatively large photosensitive areas are feasible.

A photomultiplier tube is a vacuum tube device that is commonly comprised of a radiation-sensitive photocathode that emits secondary electrons in response to photons incident on the photocathode, various dynodes which create an electron cascade from the secondary electrons emitted by the photocathode, and an anode in which a current is induced in response to the electron cascade effected by the dynodes. The anode current is sensed in external circuitry as an indicator of the radiation impinging on the photocathode. The photocathode, dynodes, anode, and other electrodes are sealed in a vacuum enclosure. The vacuum tube has a transparent faceplate window to admit radiation that impinges on the photocathode. Variations on photomultiplier tube design include the use of focusing electrodes, multiple anodes, microchannel plates and the like. Image tubes and image intensifiers work on similar principles as photomultiplier tubes, and thus can be included in applications of the present invention.

An external high-voltage power supply and voltage divider network are used to appropriately voltage bias the electrodes. In order to detect radiation with high gain and linear response, the photocathode, dynodes, anode and other electrodes, grids, or plates of the photomultiplier tube must be voltage biased with the proper polarity and voltage levels. The present invention is, in fact, predicated on modifying the response of the photomultiplier tube by modulating voltage bias of one or more electrodes of the photomultiplier tube.

Two representative types of photomultiplier tubes will be briefly described in order to facilitate discussion of the invention. FIG. 1 shows a cross-section of a photomultiplier tube comprised of several electrodes enclosed in an evacuated tube 102 sealed at one end with a stem plate 104, and at the other end with a transparent glass faceplate 106. A photocathode 108 is formed as a coating of photoemissive material on the inside of the faceplate. A focusing electrode 110, several dynodes 112, 114, 116, 118 and an anode 120 are situated in the enclosure. Various particular electrode shapes and arrangements are possible and common, however, the present invention is not limited to a specific type of photomultiplier and will find application to virtually any gateable high-voltage device.

The electrodes can be biased by independent voltage supplies 122 as shown. In practice, the electrodes are normally biased by a single high-voltage power supply that sources a voltage divider network that in turn produces a succession of electrode biasing voltages. An aspect of the invention is to utilize this voltage divider network both for the gating circuitry and for the generation of the gating voltage pulse, circumventing the need for additional high-voltage power supplies.

Photons 124 incident upon the photocathode cause the emission of electrons 126 which impact dynode 112, causing secondary emission of more electrons 128. The process is repeated among the several electrodes creating a cascade current of secondary electrons that increase in number as the cascade proceeds from the photocathode to the anode. Upon impact with the anode 120, a current is induced in the anode which develops a voltage across a load resistor 130. This voltage is indicative of the radiation incident on the photocathode that initiated the secondary electron cascade. In normal operation of the photomultiplier tube, the electrode polarities are such that electric fields are created between adjacent electrodes to accelerate electrons and direct their impact on the appropriate adjacent electrode. An optional focusing electrode 110 is sometimes included to collimate electrons emitted by the photocathode and focus those electrons on dynode 112. If any one of the electrode voltage bias polarities is reversed, the secondary electron cascade will be frustrated, as indicated, for example, by the path of secondary electron 132 which is repelled by a reverse-bias between the photocathode and focusing electrode. This effect can be used to great diminish the anode current caused by photoemission from the photocathode. Such modification and control of the secondary electron emission current by way of altering the electrode bias voltage polarity is most effective when applied to the photocathode, focusing electrode, or one of the nearby dynodes that figure in the initiation or early stages of the secondary electron cascade.

FIG. 2 shows another prevalent type of photomultiplier, similar to that of FIG. 1, except that the several dynodes are replaced by microchannel plates. As is ommon to essentially all photomultiplier devices, the electrodes and/or plates are arranged in an evacuated tube 202 sealed at one end with a stemplate 204, and at the other end with a transparent glass faceplate 206. This example shows that the photocathode can also be realized as a separate electrode 208, rather than as a coating of photoemissive material on the transparent faceplate as indicated in FIG.1. As in the previous example, the electron cascade initiated by photoemission of electrons 210 in response to radiation 212 incident on the photocathode induces a current in anode 214 which develops a voltage across a load 216 that is representative of the radiation incident on the photocathode. Microchannel plate(s) are generally comprised of a thin sheet of lead glass in which an array microscopic channels have been etched through the sheet extending from one face of the sheet to the opposite face. The channels have diameters that can range from 10 to 100 microns. Each channel functions as a continuous dynode structure. The faces of the microchannel sheet are coated with metal that provide electrical contact and permit a bias voltage of several hundred to a several thousand volts to be imposed across the thickness of the sheet. The example of FIG. 2 shows two microchannel plates 218 and 220, but other versions of this type of device may have a single microchannel plate or several microchannel plates. The electrodes are voltage biased—here indicated by separate voltage sources 218. Also as before, in practice the several electrode voltage bias levels are produced by a voltage divider network and a single high-voltage source. The voltage biasing requirements for this type of photomultiplier tube are somewhat simpler than that of FIG. 1 since there are significantly fewer electrodes due to a microchannel plate replacing a number of dynodes.

In many applications, the high sensitivity and limited operating range of a photomultiplier tube necessitates control of the photomultiplier tube responsivity. Accordingly, the ability to switch the photomultiplier tube between an ON and OFF state is referred to as "gating" and is generally useful—and often critical—in such applications. In the ON state, the photomultiplier tube generates an appreciable anode current in response to the absorption of photons in the photocathode. In the OFF state, the photomultiplier tube is non-responsive, in that the anode current is relatively small—if not negligible—regardless of whether radiation is impinging on the photocathode. Thus, the photomultiplier tube can be controlled by a gating signal in that photomultiplier tube can be desensitized to radiation incident on the photocathode that would otherwise stimulate a secondary electron cascade and induce a proportionate anode current response. This gating function has considerable utility in spectroscopy and laser ranging, to mention a few of its applications.

For example, in phosphorescence and fluorescence spectroscopy, it is necessary to detect weak optical emission that follows relatively strong optical stimulation of the sample. When the photomultiplier tube is exposed to the strong excitation radiation used to stimulate the sample, persistent anode currents, dynode voltage depletions, and gain saturation effects interfere with the subsequent detection of the weak phosphorescence or fluorescence. To avoid these effects, the photomultiplier can be switched OFF during the excitation pulse, and switched ON to a high-sensitivity, high-gain state to detect the time-delayed weak emission that follows the excitation. The required switching time is typically in the nanosecond to microsecond range.

In Light Detection And Ranging (LIDAR) systems, a laser pulse is directed at a target, the reflection from which is detected by a photomultiplier tube. The round-trip time of the laser pulse is an indicator of the range of a target such as, for example, a satellite, missile, or aircraft. During some stages of the laser pulse travel, there is considerable scatter and back reflection from the atmosphere. It is advantageous to switch the photomultiplier tube detector to an OFF state during this period and limit the ON state to predetermined detection "window" time period that includes the anticipated time of arrival of the laser pulse reflected from the target of interest.

Another purpose of photomultiplier tube gating is to reduce the deleterious effects of intense radiation on photomultiplier tube life. High light levels can produce sputtering of the photocathode material that can permanently damage the photomultiplier tube. This sputtering effect can be suppressed if the photomultiplier tube is gated OFF to reverse-bias the photocathode during periods of spurious or damaging high radiation intensities.

Analogous photomultiplier tube switching could conceivably be realized by some type of mechanical or optical shuttering. However, the switching speeds of conventional semiconductor opto-couplers, liquid crystals, mechanical shutters or choppers, and the like are generally too slow or of insufficient contrast for most detector applications.

Significant constraints and demands on the design of photomultiplier tube gating circuits are imposed by the combined requirements and/or specifications relating to the applied electrode voltage bias levels needed to adequately modulate response, switching speed, current draw, and power consumption. Particularly, the need to apply a relatively high amplitude voltage pulse—typically on the order of ten to 100 volts—in order to sufficiently bias an electrode to suppress or enhance the secondary electron cascade between electrodes, complicates the simultaneous attainment of both fast switching speeds and low power consumption. In fact, these two design objectives are generally conflicting, and a trade-off between high speed and power efficiency is inevitable, necessitating some design and performance compromises. However, improved circuit designs can make this trade-off more favorable. Moreover, it would be convenient and less costly if the high-voltage source and associated voltage divider network used to statically bias the photomultiplier tube electrodes could also be used for generating the gate voltage and powering the associated gating circuitry. In such a case, a gate voltage pulse sourced by the voltage divider network would be applied to the appropriate electrode under the control of a supplementary gate voltage switching circuit that is also powered by the voltage divider network.

As there are a wide range of specifications for gating circuits according to the diverse applications of photomultiplier tubes, it is not surprising then that there are many variations and performance characteristics of photomultiplier tube gating schemes and supporting circuitry. The present invention adds to the stock of photomultiplier gating circuits in its description of a gating circuit that: 1. is sourced by the voltage divider network and thus requires no additional high voltage supplies, 2. provides wide latitude in adjusting the amplitude of the high-voltage electrode bias pulses used to gate an electrode, 3. draws very small currents from the photomultiplier tube power supply, and 4. is compatible with low-voltage level transistor-transistor logic signals as are common in instrumentation such as commercial pulse generators. With regard to this last point, the excitation pulse can be synchronized with a detection window determined by selectively gating the photomultiplier tube. For example, in spectroscopy or LIDAR, the laser pulse is fired by a low-voltage signal generator, the output of which can also be used, with appropriate built-in time delays, as a triggering signal for the photomultiplier tube gating circuit. This capability can be used to limit detection intervals to the anticipated arrival times of the radiation of interest, and block the detection of radiation that falls outside this detection window. Moreover, the photomultiplier tube gain—determined partly by the electrode voltage biases—can be optimally set for sufficiently high sensitivity and responsivity, without the deleterious and interfering after-effects of any intense or spurious radiation incident upon the photocathode at times immediately preceding the detection interval.

SUMMARY OF INVENTION

A pulse and clamp gating circuit switches ("gates") a photomultiplier tube between an ON responsive operating state and an OFF non-responsive operating state by applying a voltage pulse to a photomultiplier tube electrode. In the ON state, an appreciable photomultiplier anode current is generated in response to radiation incident on the photocathode. In the OFF state, the anode current response is desensitized to radiation incident on the photocathode. The circuit can gate photomultiplier tubes with dynodes and/or focusing electrodes, as well as microchannel plates, gateable image tubes or intensifiers.

The pulse and clamp circuit is triggered by a low-level (0 to 5 volts) input signal. This low-level input signal is compatible with transistor-transistor logic and is commonly available in many commercially available pulse generators. The pulse and clamp circuit generates a pulse with a sufficiently high voltage swing to switch the polarity of voltage bias between a pair of photomultiplier tube electrodes. The electrode pair bias is modulated from a reverse-bias non-conducting state, in which case the photomultiplier is desensitized to radiation incident on the photocathode and the anode current is very small, to a forward-biased conducting state, in which case the photomultiplier tube is responsive to radiation with a resultant anode current response.

The photomultiplier tube electrodes are biased by a voltage divider network sourced by a high voltage power supply. The voltage divider network can be modified to power the pulse and clamp circuit as well as source the gating voltage that is controlled by the pulse and clamp circuit and applied to an electrode of the photomultiplier tube to modulate responsivity. Thus, with the present invention a separate high voltage pulse generator is not needed for gating photomultiplier tube.

The low-level input signal is voltage-level shifted by a CMOS (complementary metal oxide semiconductor) integrated circuit which yields a gain of approximately 3 in the input signal. The current sourcing capability of this signal is increased by Class B output stage amplifiers, each comprised of a pair complementary bipolar transistors. The complementary bipolar transistor amplifiers drive field effect transistor switches connected in a totem-pole configuration. The common drain output from the totem-pole field-effect transistor is capacitively coupled to the photocathode of a photomultiplier tube. Alternatively, this output could be coupled to a dynode, grid, or focusing electrode for a similar gating effect. During the OFF condition, when the photocathode is reverse-biased, a diode or series of diodes clamps the photocathode at a fixed reverse bias established by a reverse-biased Zener diode in the voltage divider network. The photomultiplier tube is gated ON by a bias voltage pulse generated by the pulse and clamp circuit in response to triggering by the low-level input signal and applied to the photocathode, the photocathode is transiently forward biased to a conducting responsive state. The rise and fall times and duration of the forward-biasing pulse can be controlled by the particular resistor and capacitor values of the pulse and clamp circuit and the pulse width of the input gating signal.

The pulse and clamping circuit current draw and power consumption represents an almost negligible burden on the voltage divider network and its high voltage power supply. Specifically, the small transient switching current generated during the forward-biasing gate cycle is short in duration and places no significant direct current demand on the high voltage power supply relative to the quiescent current values of the voltage divider network.

Additionally, the invention provides for circuit elements that inhibit spurious or premature gating during power up, enabling gating operation only after the voltage divider network reached a stable operating point.

In summary, the invention provides for a gating amplifier that is powered from the voltage divider network and will generate a high voltage pulse sufficient for gating the photocathode, dynode, focusing electrode, or other grid of photon detection devices including photomultiplier tubes, microchannel plates, image intensifier, image tubes, and other high-voltage gateable devices.

BRIEF DESCRIPTION OF THE DRAWINGS

The foregoing summary and the following detailed description will be better understood when read with reference to the drawings, wherein.

DETAILED DESCRIPTION

Figure 1:
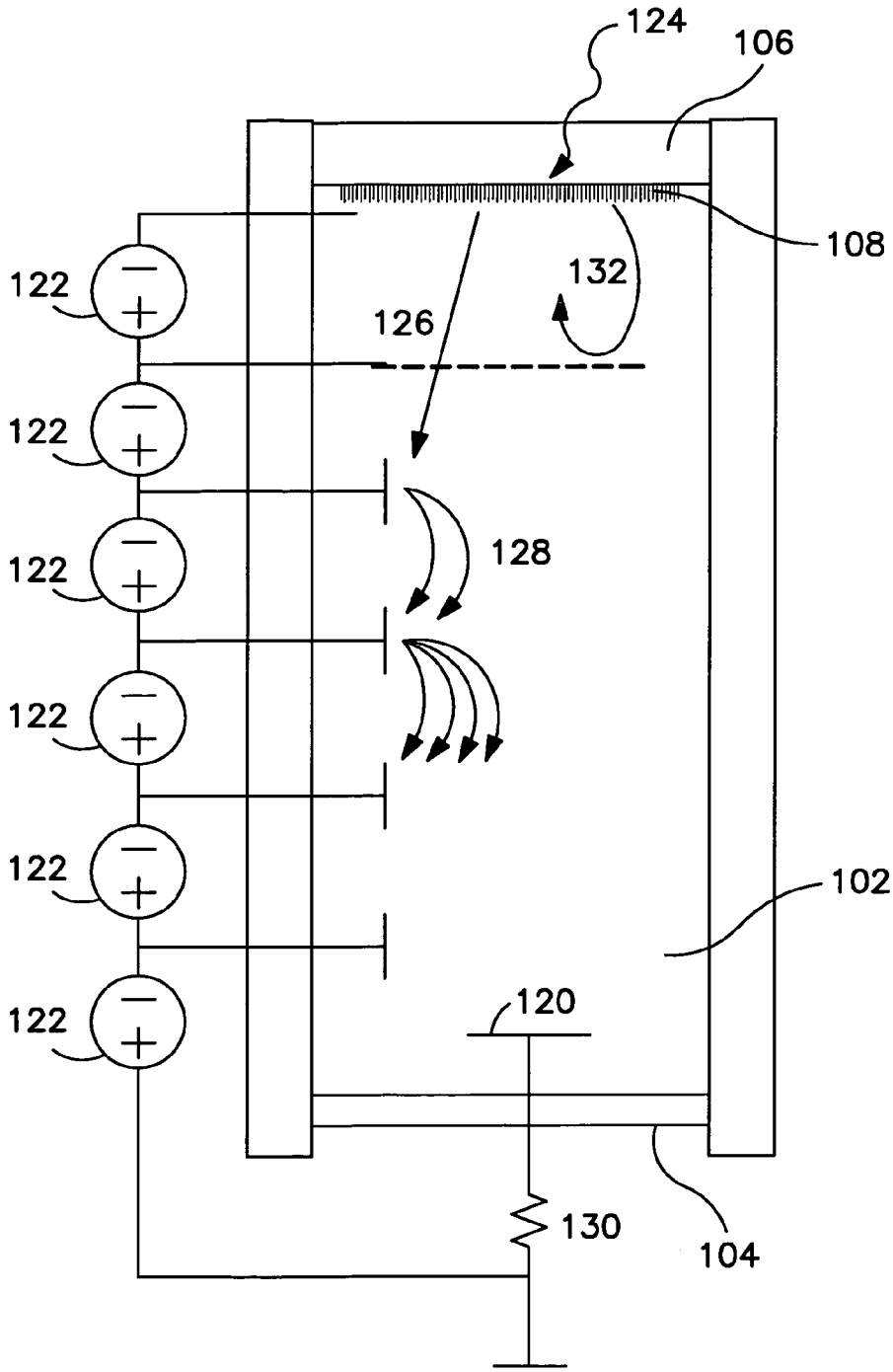
FIG. 1 PRIOR ART
FIG. 1 is a schematic diagram of a known type of photomultiplier tube.

A photomultiplier tube is biased by a voltage divider network sourced by a negative high-voltage power supply. For a photomultiplier tube with several dynodes and a possibly an additional focusing electrode, as for example shown in FIG. 1, the several electrodes are appropriately biased by various voltage levels produced by the voltage divider network. This type of photomultiplier tube can be gated by applying a reverse-bias voltage pulse to the photocathode, the focusing electrode or one of the dynodes near the photocathode.

Figure 2:
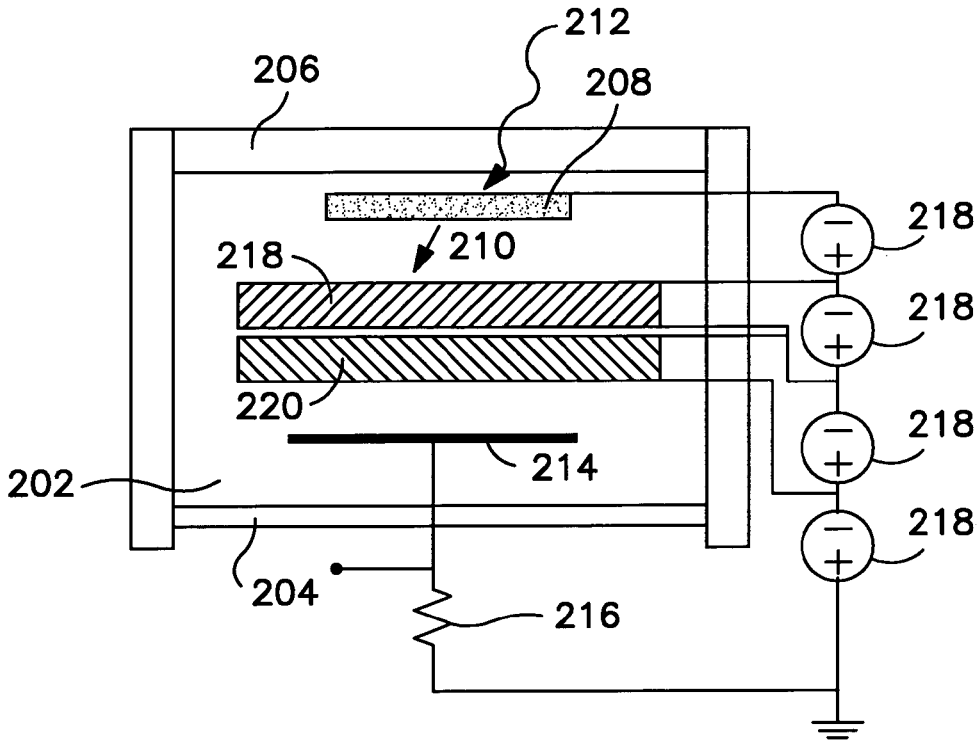
FIG. 2 PRIOR ART
FIG. 2 is a schematic diagram of a second known type of photomultiplier tube.

In the case of a microchannel plate type photomultiplier tube, as for example shown in FIG. 2, the voltage divider network provides appropriate voltage bias levels for the microchannel plates and photocathode. The photomultiplier tube can be gated by applying a voltage pulse to the photocathode, or to one of the microchannel plates.

The invention will be described in specifics and detail for this type of microchannel photomultiplier tube, but it will be understood that the invention is applicable to all types of photomultiplier tubes and related devices in which the responsivity can be controlled by modulating the voltage bias of one or several electrodes, plates, or grids.

Figure 3:
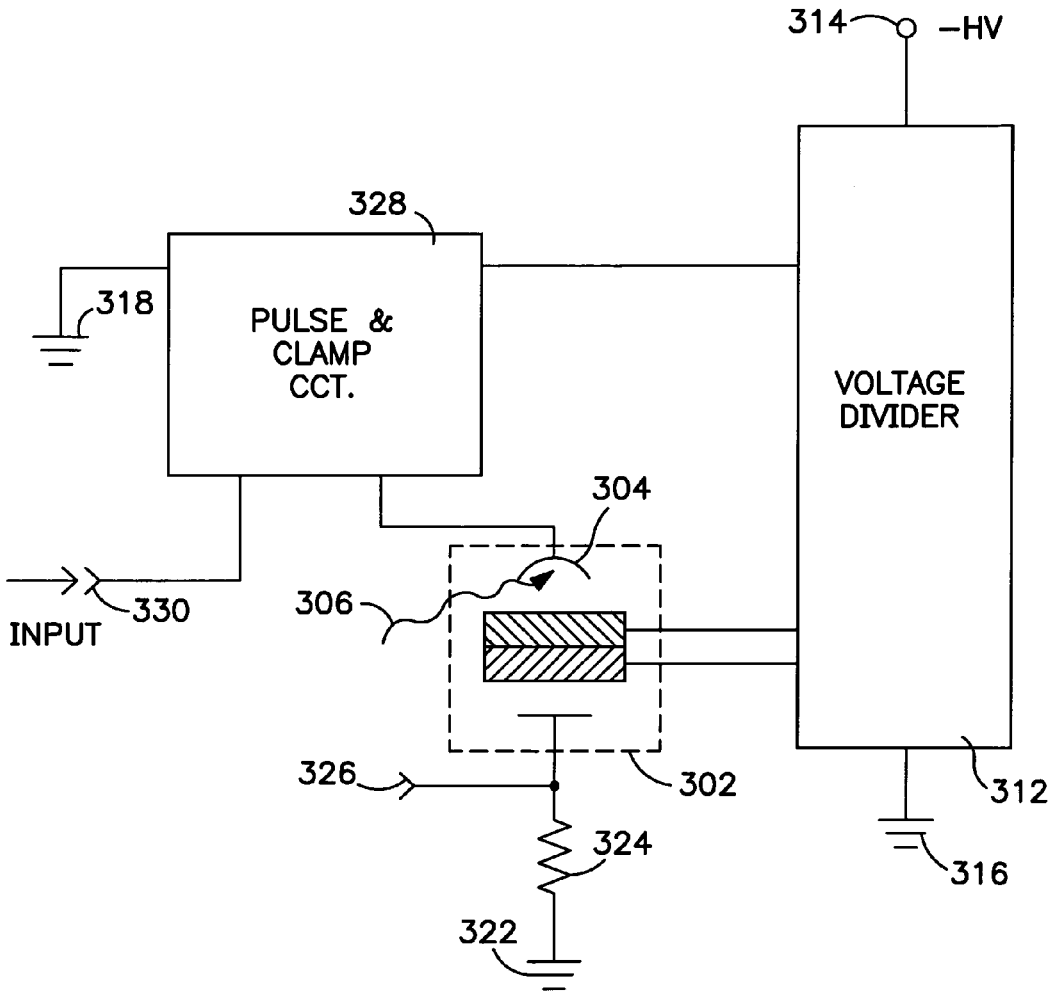
FIG. 3 is a schematic diagram of a photomultiplier tube according to the present invention, including associated circuitry.

A basic schematic of the photomultiplier tube gating circuitry that is the subject of the present invention is shown in FIG. 3. A microchannel photomultiplier tube 302 comprised of a photocathode 304 exposed to incident radiation 306, and microchannel plates 308 and 310 are biased as shown by a voltage divider network 312 that is sourced by a negative high voltage 314 with respect to ground potential 316 and 318. The anode 320 is generally connected to ground 322 through a load resistor 324, across which a voltage output signal at node 326 is produced. Other anode current sensing circuitry is also possible. The photocathode 304 is biased negative with respect to the microchannel plates 308 and 310.

The photocathode potential bias with respect to the microchannel plate can be modulated by a pulse and clamp circuit 328. This circuit effects gating of the photomultiplier tube by providing either a forward bias to the photocathode, thus allowing and enhancing an electron cascade current initiated by cathode photoemission of secondary electrons, or else a reverse bias voltage to the photocathode, thus suppressing any electron cascade current due to photoemission from the photocathode. The photocathode bias provided by the pulse and clamp circuit is controlled by a low-voltage gating signal applied at its input 330. This gating signal is a transistor-transistor-level (TTL) logic signal and in spectroscopy applications would typically be produced by the pulse generator controlling the excitation light source. The pulse and clamp circuit is powered by the voltage divider network, and thus obviates the need for a separate power supply.

Figure 4:
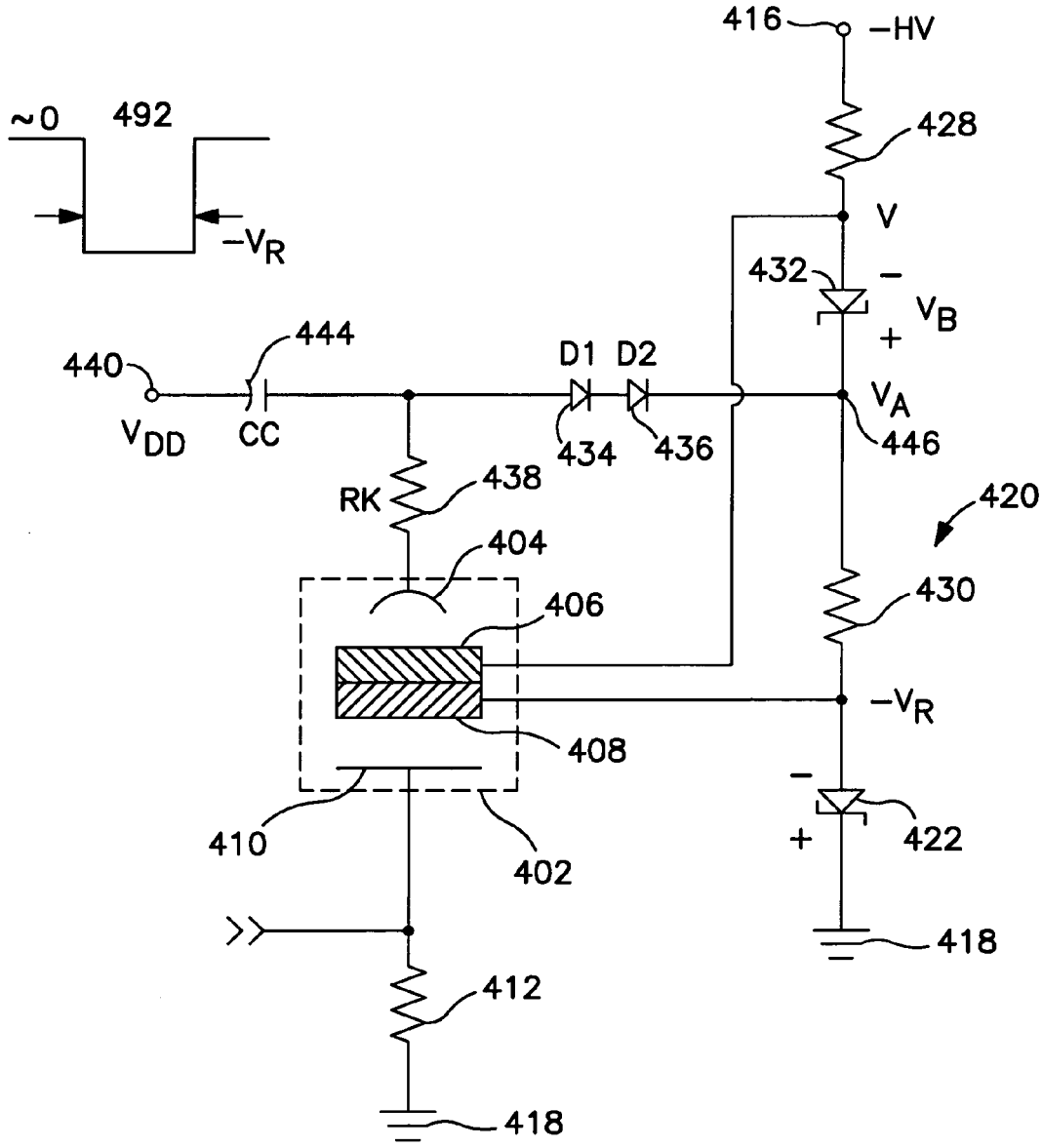
FIG. 4 is a detailed schematic diagram of the photomultiplier of FIG. 3 showing a preferred arrangement of the voltage divider network and the gating pulse coupling circuit.

FIG. 4 indicates the method of producing the electrode biases and manner in which a voltage pulse is used to gate the photomultiplier tube in the scheme of the present invention. Photomultiplier tube 402 is comprised of a photocathode 404, microchannel plates 406 and 408, an anode 410, in which an induced current generates a voltage across resistive load 412. The photomultiplier tube is biased by voltage divider network 420 powered by a voltage source with negative polarity 416 with respect to ground 418. The voltage divider network 420 produces distinct voltage levels using a series connection of resistors and reverse-biased Zener diodes. More specifically, a reverse-biased Zener diode 422 establishes a voltage $-V_R$ at node 424 that is used to bias one side 408 of the microchannel plate(s). A combination of resistive loads 428 and 430 and Zener diode 432 biases the front-end of the microchannel plate 406 (side closest to the photocathode) with a more negative voltage than the side 408 of the microchannel closest to the anode. The photocathode is connected to the voltage divider through two diodes 434 and 436 and a resistor 438. Under normal operation, the voltage ($V_{D-D}$) applied at node 440 is close to ground, and Zener diode 432 maintains the photocathode at $V_B$ (about 25 volts) positive with respect to the microchannel plate 406. Thus, under these conditions the photocathode is reverse-biased with respect to the microchannel plate, and the secondary electron cascade is suppressed, regardless of whether the photocathode is irradiated. In response to triggering by the TTL level input signal to the pulse and clamp circuit, a negative-going voltage pulse 442 is applied to node 440. As will be described in more detail, the negative amplitude of this pulse is approximately equal to $-V_R$ established in the voltage divider network, and thus the value of $-V_R$ can be adjusted by the choice of Zener diode 422, or a combination of Zener diodes with particular reverse-bias breakdown voltages. The voltage bias pulse applied at node 440 is capacitively coupled to photocathode 404 through resistor 438 and capacitor 444. Under steady-state conditions, when all switching transients have decayed, the voltage of the photocathode is equal to the voltage $V_A$ at node 446, established by the voltage divider network. It is noted that Zener diode 432 maintains the microchannel plate at a more negative potential ($V_B$) than the photocathode, and therefore the microchannel plate is reverse-biased with respect to the photocathode. Thus, this biasing arrangement maintains the photomultiplier tube in a normally-OFF (nonresponsive) state. The application of negative voltage pulse 442 at node 440 induces charging currents (mainly for capacitor 444) that as a consequence transiently forward bias the photocathode with respect to the microchannel plate, resulting in an ON state for some period of time determined by the resistance and capacitance characteristics of the circuit and the width of gating voltage pulse 442.

Figure 5:
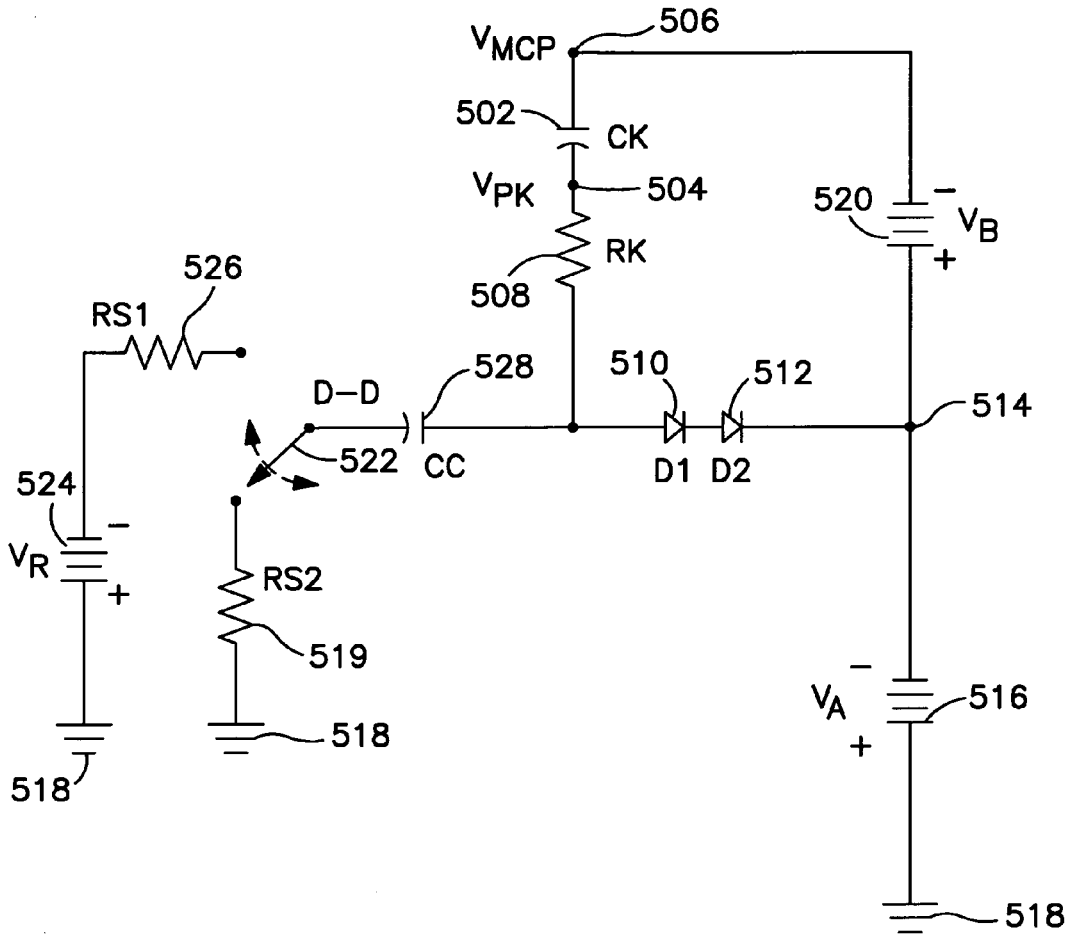
FIG. 5 is a schematic diagram of the equivalent circuit of the photomultiplier of FIG. 4.

FIG. 5 shows an equivalent photocathode charging circuit for the schematic of FIG. 4. This circuit illustrates how a pulse applied at node 522 transiently changes the bias of the photocathode with respect to the microchannel plate. Capacitor 502 represents the capacitance between the photocathode and microchannel plate. The potential of the photocathode (at node 504) is denoted as $V_{PK}$. The potential of the microchannel plate (at node 506) is denoted by $V_{MCP}$. Under steady-state conditions, such that all currents in this circuit are nil except for small leakage currents, the photocathode is connected through resistor 508, diode 510, and diode 512 to node 514 which is maintained at potential $-V_A$ with respect to ground 518. Under steady-state conditions, the microchannel plate potential $V_{MCP}$ (at node 506) is maintained at $-V_B$ volts with respect to the photocathode potential $V_{PK}$ (at node 504).

The pulse and clamp circuit (not shown) effects switching node 522 between a negative voltage $-V_R$ with a source resistance 526 and a near-ground potential 518 with a source resistance 519. Resistors 526 and 518 have approximately equal resistance. This switching between two voltages represents the negative-going square pulse (442 in FIG. 4) produced by the pulse and clamp circuit. The switching voltage at node 522 is capacitively coupled to the photocathode through capacitor 528 and resistor 508. A typical capacitance value for capacitor 528 is 0.01 microfarads, and for capacitor 502 is about 10 picofarads. Thus, the transient current through capacitor 502 is small compared to that through capacitor 528. Therefore, the rise and fall times of the photocathode potential $V_{PK}$ are determined mainly by the RC time constants of the respective RC networks. The forward-bias voltage (corresponding to the ON state) is sustained by the charge on capacitor 528 caused by its charging when node 522 is switched to $-V_R$, in response to the negative-going transition of the input pulse. This charge will change to that corresponding to the reverse-bias (OFF state) when node 522 is switched to ground, in response to a positive-going transition of the input pulse. Even without switching node 522 to ground, the photocathode potential will eventually return to the potential at node 514, equal to $V_A$, as capacitors 528 and 502 discharge through diodes 510 and 512, corresponding to the OFF state. The modulating voltage bias that gates the photomultiplier tube is in effect a transient pulse that is triggered by the rising and falling edges of the amplified and voltage-level shifted input gating signal. Moreover, the rise and fall times can be adjusted through the resistance values of resistors 526, 519, and 508, and the capacitance of capacitor 502.

Figure 6:
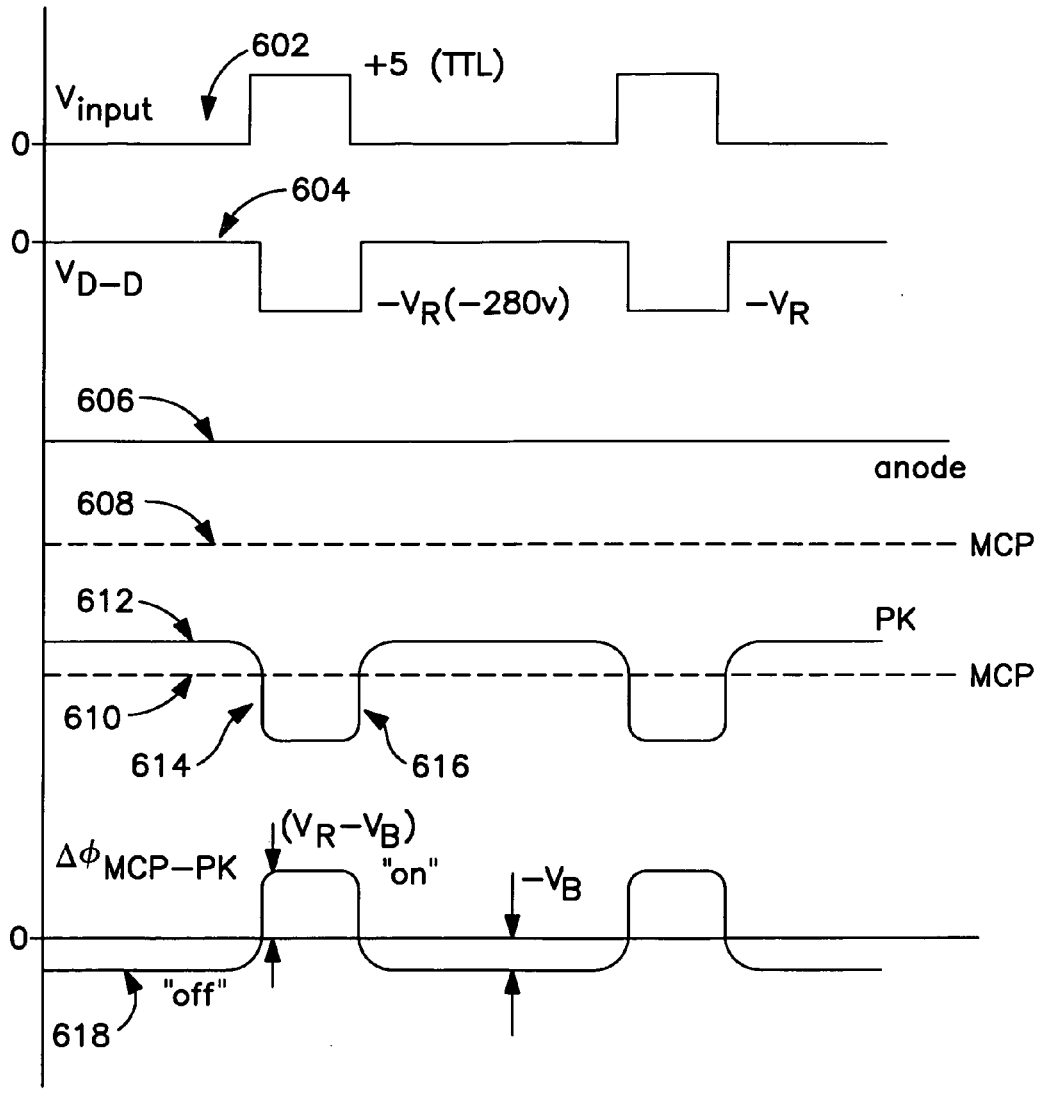
FIG. 6 is a graph of representative pulse waveforms that appear at various points in the circuits of the photomultiplier of FIG. 4.

FIG. 6 shows some representative waveforms of various voltage levels that occur in the gating of the photomultiplier tube and their timing relationships. All waveforms are plotted on the same time axis. An input gating signal 602 in the form of an approximate 5-volt amplitude pulse is applied at the input terminal (330 in FIG. 3 or 440 in FIG. 4) and controls the voltage pulse, shown as waveform 604, that is applied at the input terminal. The corresponding wave forms of the anode voltage signal 606, the front side microchannel plate voltage signal 608, the backside microchannel plate voltage signal 610, and the photocathode voltage signal 612 are also shown. A turn-on time results from the finite fall-time (90% to 10% maximum) of negative-going pulse edge 614. Similarly, a turn-off time results from the finite fall-rise (10% to 90% maximum) of positively-going pulse edge 616. The voltage difference between the photocathode and microchannel plate are shown in trace 618. The photomultiplier tube is in the ON state only when this potential difference is positive, indicating the photocathode is forward-biased with respect to the microchannel plate.

Figure 7:
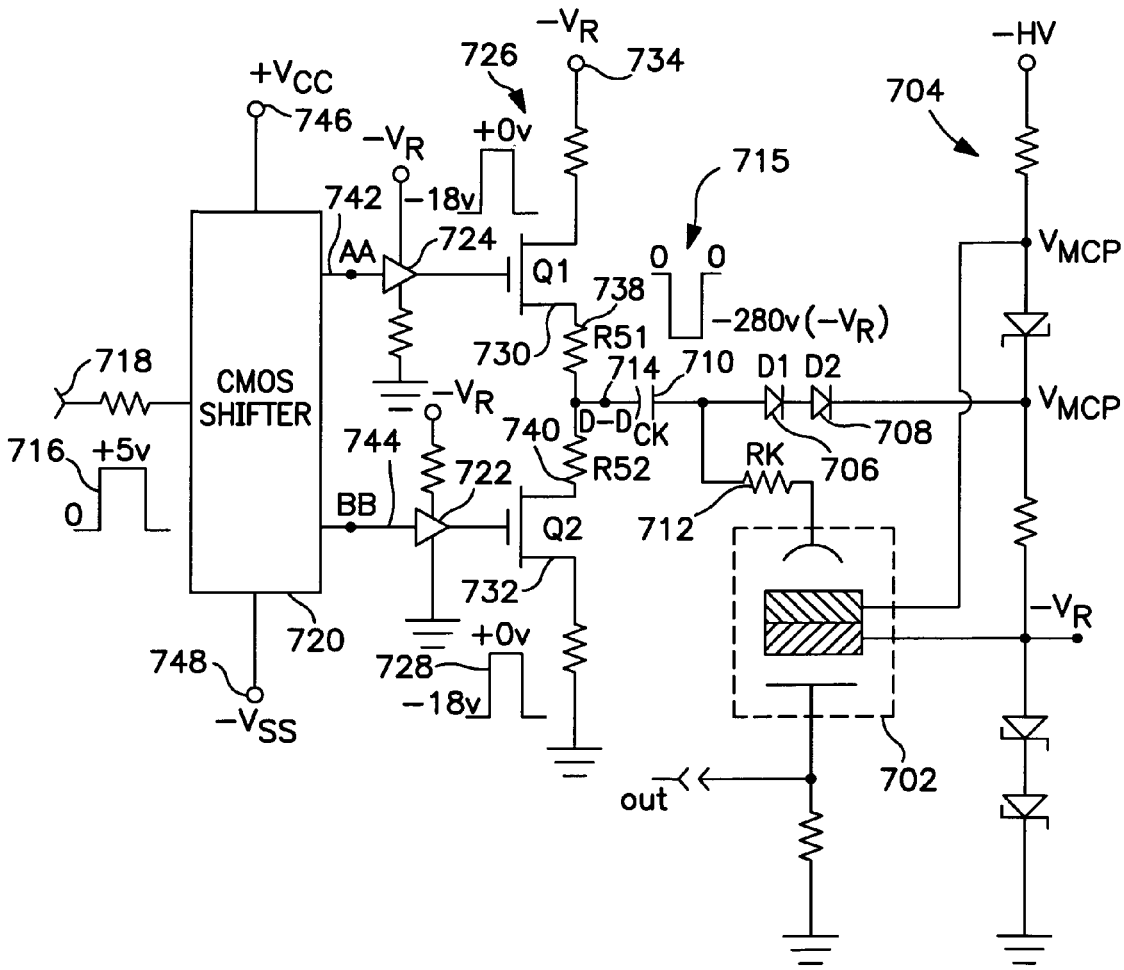
FIG. 7 is a schematic diagram that shows a preferred arrangement of the pulse and clamp circuit of the photomultiplier tube FIG. 4.

FIG. 7 shows a general scheme of the pulse and clamp amplifier used to generate the photocathode gating pulse. The photomultiplier tube 702 is biased with a voltage divider circuit 704 and associated charging circuitry comprised of diodes 706 and 708, capacitor 710 and resistor 712. The voltage $V_{D\text{-}D}$ at node 714 is switched between ground and a negative potential $-V_R$ as indicated by pulse 715. The low-level (0 to 5 volt) input gating pulse 716 applied at input terminal 718 drives a CMOS voltage-level shifter 720. The output of the voltage level shifter is buffered by unity-gain non-inverting amplifiers 722 and 724. Two identical voltage level-shifted pulses are produced. The voltage level shifter changes the signal levels of logical from 0 (ground) to −18 volts, and logical 1 from +5 volts to 0 volts (ground) as indicated by pulses 726 and 728. The switching of node 714 is effected by two complementary field-effect transistors 730 and 732 to which pulses 726 and 728 are applied to the respective gates of the respective transistors. Transistors 730 and 732 are connected in a "totem-pole" configuration and the common drain output at node 714 which is capacitively coupled to the photocathode through capacitor 710 and resistor 712. When pulses 726 and 728 are high (0 volts), transistor 730 is ON (conducting) and transistor 732 is OFF (non-conducting), and node 714 is pulled to $-V_R$, which is the bias applied at node 734. Conversely, when pulses 726 and 728 are low (−18 volts), transistor 732 is ON (conducting), transistor 730 is OFF (non-conducting), and node 714 is pulled to ground potential. Field-effect transistors in such a totem-pole configuration are able to source the high levels of current needed for fast switching of the photocathode potential. Resistors 738 and 740 correspond to the source resistors shown in the switched voltage sources of FIG. 5. The voltage level shifter, which produces parallel, nominally identical output pulses 726 and 728 at its output lines 742 and 744 from a single input gating signal 716 applied at input 718, is sourced by two voltage levels $V_{CC}$ at terminal 746 and $-V_{SS}$ at terminal 748. Voltage levels $V_{CC}$, $-V_{SS}$, as well as $-V_R$, are derived from the voltage divider network.

Figure 8:
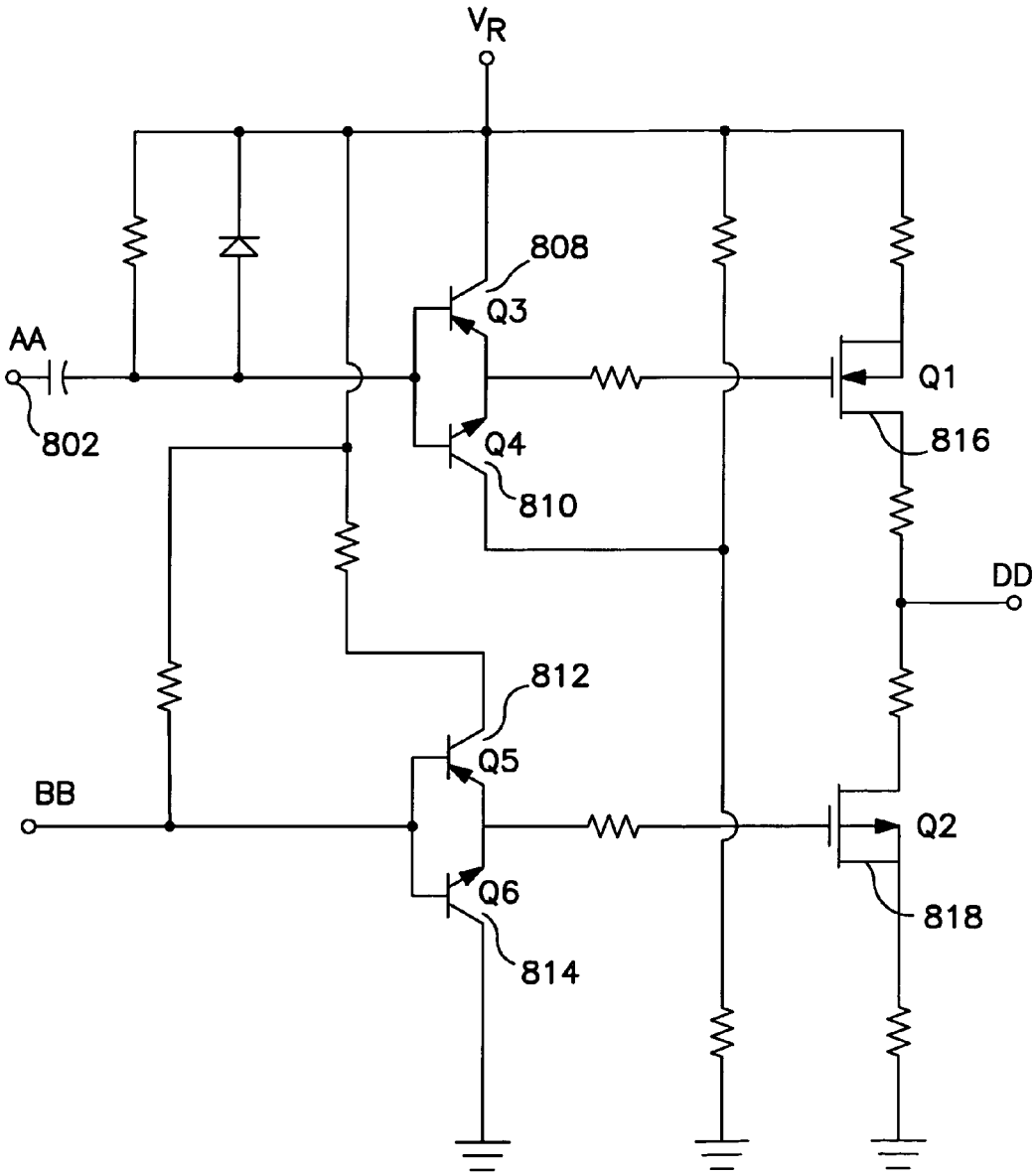
FIG. 8 is a schematic diagram of a preferred arrangement of the amplifier used to source the gating voltage applied to the photomultiplier of FIG. 4.

FIG. 8 shows a preferred implementation of the unity-gain non-inverting amplifiers and the totem-pole configured field-effect transistor switch used in the gating circuit according to the present invention. With reference to FIG. 7, FIG. 8 shows the circuit arrangement between the outputs 742 and 744 of the CMOS shifter 720 and the node 714 at the common drain of the field effect transistors 730 and 732. The unity-gain, non-inverting amplifiers can source relatively large switching currents needed for high-speed switching of the field-effect transistors. The unity-gain amplifiers are realized in a configuration commonly known in the art of electronics as a Class B output stage. Transistors 808 and 810 form an amplifier that buffers the voltage signal at node 802 to drive the gate of field-effect transistor 816. Similarly, transistors 812 and 814 form an amplifier that drives the gate of field-effect transistor 818. For example, when the input signal at line 802 is zero volts, both transistors 808 and 810 are non-conducting. When the voltage on line 802 goes negative, transistor 808 conducts and transistor 818 remains off. The amplifier formed by transistors 808 and 810 draws bias current only during the ON phase of the gating pulse, thus saving power during the time the gating circuit is idling in the OFF state. Similar functions occur for the analogous Class B amplifier realized by transistors 812 and 814.

Figure 9:
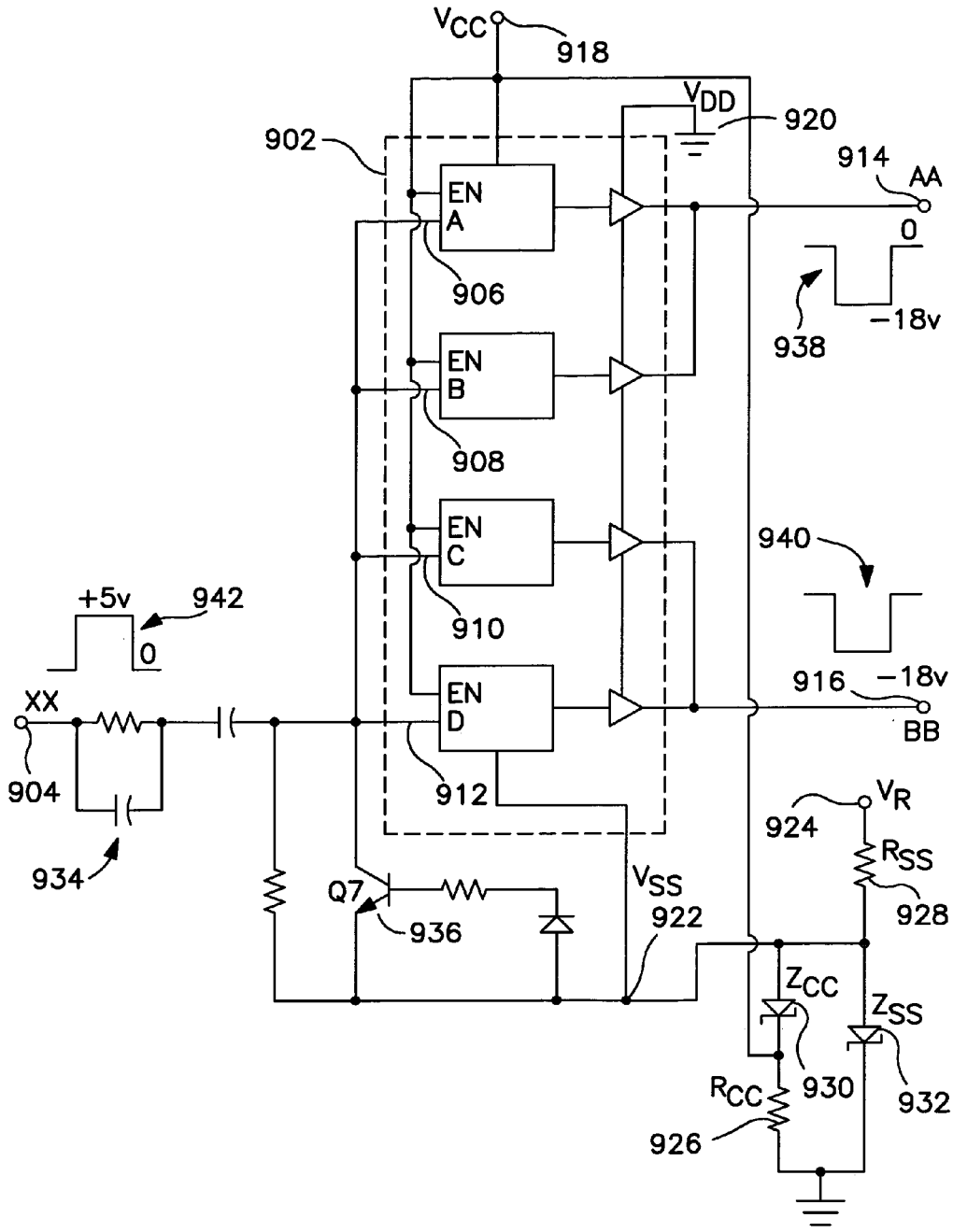
FIG. 9 is a schematic diagram of a preferred arrangement of a voltage level shifter and protection circuitry used in of the gating circuit of FIG. 4.

FIG. 9 shows a preferred arrangement of the voltage-level shifting circuit which is based on a commercially-available integrated circuit 902 such as an SGS-Thompson HCC40109B Quad Low-to-High Voltage Level Shifter, or equivalent. This voltage level shifter provides an interface for TTL-compatible input gating signals applied at terminal 904 and yields a gain of about 3 in the input gating pulse. The voltage level shifter circuit has four low-to-high voltage level shifting circuits with inputs 906, 908, 910, and 912. The outputs from two voltage level shifters are tied together in pairs to produce two nominally identical amplified output pulses at terminals 914 and 916. The voltage level shifter shifts a digital logic input signal with logical $1=V_{CC}$ and logical $0=V_{SS}$ to a higher level output signal with logical $1=V_{DD}$ and logical $0=V_{SS}$. The voltage levels $V_{CC}$ at terminal 918, $V_{DD}$ at terminal 920, and $V_{SS}$ at terminal 922 are set by external voltage sources. In the present invention those voltages are derived from $V_R$ at terminal 924 as shown, which in turn is produced by the voltage divider network. Thus, all voltage supplies for this circuit are provided by the voltage divider network, and no additional power supplies are required. $V_{DD}$ is set to ground, and $V_{CC}$ and $V_{SS}$ are set by the voltage divider circuit formed by resistors 926 and 928, and Zener diodes 930 and 932, and sourced by voltage $V_R$ from the voltage divider network. A resistor-capacitor network 934 filters electrical noise at the input of the voltage-level shifter. Transistor 936 prevents premature gating response until the normal operating voltage source potentials are established. Transistor 936 inhibits gating for a short time upon power up of the system to allow voltage divider network potentials to stabilize. In summary, the operational result of the circuit of FIG. 9 is to produce identical voltage pulses 938 and 940 in response to a gating signal input 942.

Figure 10:
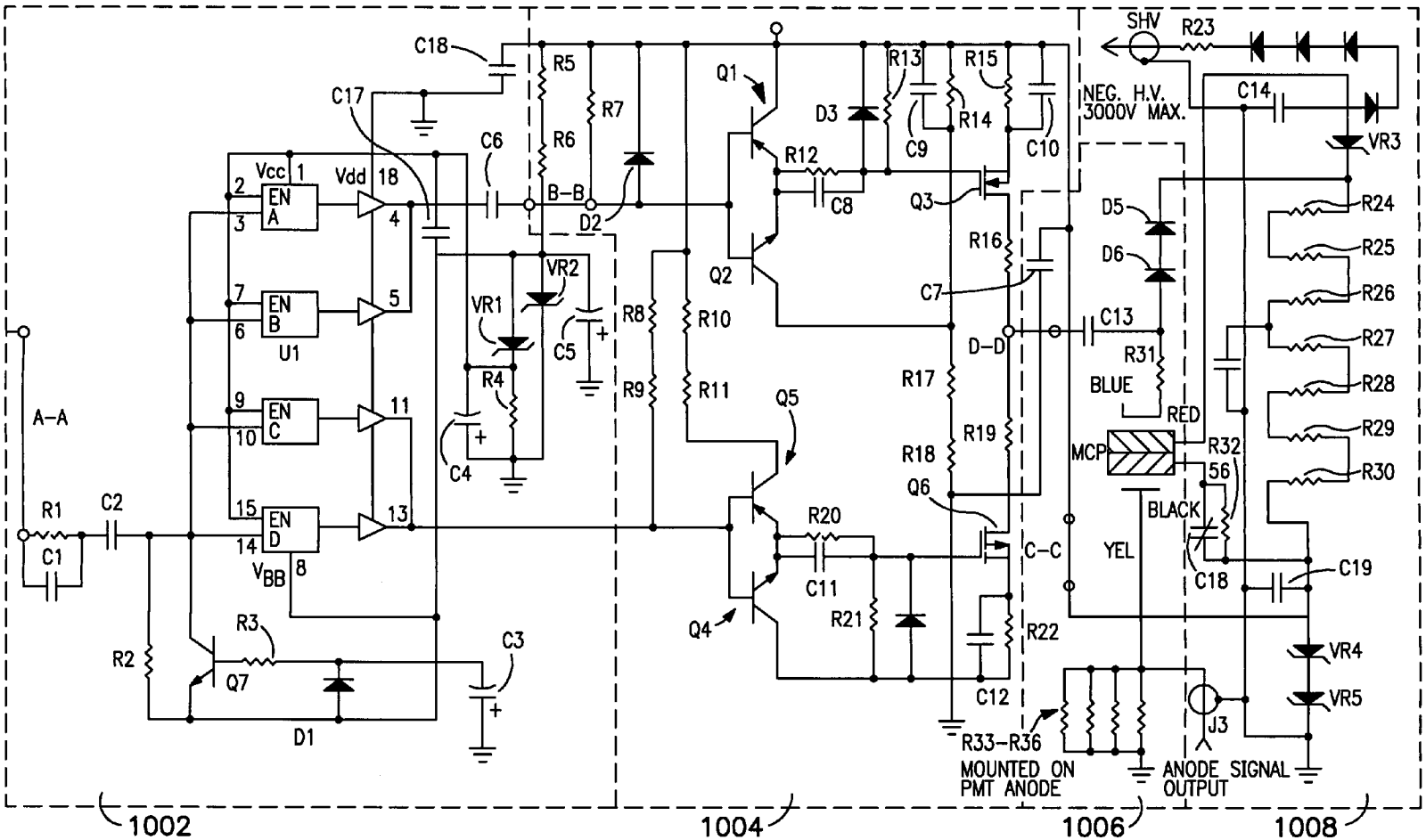
FIG. 10 is a schematic diagram of a preferred embodiment of a gating and voltage divider circuit for a photomultiplier according to the present invention.

FIG. 10 shows a particular and detailed implementation of the invention including specific commercially available components. This circuit encompasses all of the features described with respect to FIGS. 3 to 9. More particularly, front-end section 1002 functions as the input stage voltage level shifter and accessory protective circuitry described with respect to FIG. 9. Section 1004 shows the intermediate stage of the invention, providing voltage gain and current switching as described with respect to FIG. 8. Section 1006 shows the photocathode capacitively coupling circuit elements and connections to the photomultiplier tube for static biasing as described with respect to FIG. 4. Section 1008 shows the utilization of a voltage divider network that provides various voltage levels for biasing the electrodes of the photomultiplier tube and gating pulse circuit, and as was explained with respect to FIG. 4.

In the quiescent normally OFF state, the photocathode is biased approximately 25 volts positive with respect to the microchannel plate, thus suppressing secondary electron current and rendering the photomultiplier tube non-responsive to incident radiation. A positive-going TTL (transistor-transistor logic) compatible 5-volt pulse applied at the input switches the photomultiplier tube to the ON state by capacitively coupling a negative voltage pulse (with respect to ground) to the photocathode, which forward biases the photocathode by about 250 volts with respect to the microchannel plate. In this particular implementation of the circuit, the turn-on TTL gate pulse is adjustable by the user from 250 nanoseconds to 20 microseconds. Duty cycles, i.e., pulse repetition rates, up to 100 kilohertz are feasible. The turn-on and turn-off times (rise- and fall-of the electrode gating pulse) are approximately 70 ns. With no gating pulses, the circuit draws 707 microamps for the voltage divider network sourced with a 3000 volt power supply. Gating with a 10 kilohertz signal increases the current draw to 712 microamps. The small transient switching currents thus represent a negligible burden relative to the quiescent currents normally encountered in biasing a photomultiplier tube.

It will be recognized by those skilled in the art that changes or modifications may be made to the above-described embodiment without departing from the broad inventive concepts of the invention. It is understood, therefore, that the invention is not limited to the particular embodiment which is described, but is intended to cover all modifications and changes within the scope of the invention as defined in the appended claims.

What is claimed is:

1. Apparatus for providing a modulated signal in response to incident radiation comprising:

means responsive to incident radiation for emitting electrons in response to such radiation;

electron multiplication means disposed for receiving the electrons emitted by said radiation responsive means and multiplying said electrons;

an anode disposed for receiving the multiplied electrons and providing an electrical signal in response thereto;

a voltage divider network connected to said electron multiplication means for providing a biasing voltage thereto when connected to a high voltage power supply; and a gating circuit operatively connected to said radiation responsive means, said voltage divider network, and an external input signal source, said gating circuit being adapted for providing a gating signal to said radiation responsive means in response to an input signal from said external input signal source, whereby said apparatus can be modulated between respective ON and OFF states; said gating circuit comprising:

voltage level shifting means operatively connected to receive the external input signal and for providing a voltage level shifted output signal in response to the external input signal; and a switching circuit operatively connected between said voltage divider network and ground and to said voltage level shifting means, said switching circuit being adapted for providing the gating signal to the radiation responsive means.

2. An apparatus as set forth in claim 1 wherein the radiation responsive means comprises a photocathode.

3. An apparatus as set forth in claim 1 comprising a current amplifier operatively connected between said voltage level shifting means and said switching circuit.

4. Apparatus as set forth in claim 1 wherein said electron multiplication means comprises a dynode having a secondary electron emissive surface.

5. Apparatus as set forth in claim 4 wherein said electron multiplication means comprises a plurality of dynodes each having a secondary electron emissive surface.

6. Apparatus as set forth in claim 1 wherein said electron multiplication means comprises a microchannel plate.

7. Apparatus as set forth in claim 6 wherein said electron multiplication means comprises a second microchannel plate.

8. Apparatus for providing a modulated signal in response to incident radiation comprising:

means responsive to incident radiation for emitting electrons in response to such radiation;

electron multiplication means disposed for receiving the electrons emitted by said radiation responsive means and multiplying said electrons;

an anode disposed for receiving the multiplied electrons and providing an electrical signal in response thereto;

a voltage divider network connected to said electron multiplication means for providing a biasing voltage thereto when connected to a high voltage power supply; and a gating circuit operatively connected to said radiation responsive means, said voltage divider network, and an external input signal source, said gating circuit being adapted for providing a gating signal to said radiation responsive means in response to an input signal from said external input signal source, whereby said apparatus can be modulated between respective ON and OFF states; said gating circuit comprising:

voltage level shifting means operatively connected to receive the external input signal and for providing two voltage level shifted output signals in response to the external input signal; and a logic circuit operatively connected between said voltage divider network and ground and to said voltage level shifting means, said logic circuit being adapted for providing the gating signal to the radiation responsive means.

9. An apparatus as set forth in claim 8 comprising first and second current amplifiers operatively connected between said voltage level shifting means and said logic circuit.

10. Apparatus for providing a modulated signal in response to incident radiation comprising:

a photocathode responsive to incident radiation for emitting electrons in response to such radiation;

electron multiplication means disposed for receiving the electrons emitted by said photocathode and multiplying said electrons;

an anode disposed for receiving the multiplied electrons and providing an electrical signal in response thereto;

a voltage divider network connected to said photocathode and said electron multiplication means for providing a biasing voltage thereto when connected to a high voltage power supply; and a gating circuit operatively connected to said electron multiplication means, said voltage divider network, and an external input signal source, said gating circuit being adapted for providing a gating signal to said electron multiplication means in response to an input signal from said external input signal source, whereby said apparatus can be modulated between respective ON and OFF states; said gating circuit comprising voltage level shifting means operatively connected to receive the external input signal and for providing a voltage level shifted signal in response to the external input signal; and a transistor switch operatively connected between said voltage divider network and ground and to said voltage level shifting means, said transistor switch being adapted for providing the gating signal to the electron multiplication means.

11. An apparatus as set forth in claim 10 comprising a current amplifier operatively connected between said voltage level shifting means and said transistor switch.

12. Apparatus as set forth in claim 10 wherein said electron multiplication means comprises a dynode having a secondary electron emissive surface.

13. Apparatus as set forth in claim 12 wherein said gating circuit is operatively connected to said dynode.

14. Apparatus as set forth in claim 12 wherein said electron multiplication means comprises a plurality of dynodes each having a secondary electron emissive surface.

15. Apparatus as set forth in claim 14 wherein said gating circuit is operatively connected to at least one of said plurality of dynodes.

16. Apparatus as set forth in claim 10 wherein said electron multiplication means comprises a microchannel plate.

17. Apparatus for providing a modulated signal in response to incident radiation comprising:

a photocathode responsive to incident radiation for emitting electrons in response to such radiation;

electron multiplication means disposed for receiving the electrons emitted by said photocathode and multiplying said electrons;

an anode disposed for receiving the multiplied electrons and providing an electrical signal in response thereto;

a voltage divider network connected to said photocathode and said electron multiplication means for providing a biasing voltage thereto when connected to a high voltage power supply; and a gating circuit operatively connected to said electron multiplication means, said voltage divider network, and an external input signal source, said gating circuit being adapted for providing a gating signal to said electron multiplication means in response to an input signal from said external input signal source, whereby said apparatus can be modulated between respective ON and OFF states; said gating circuit comprising:

voltage level shifting means operatively connected to receive the external input signal and for providing two voltage level shifted output signals in response to the external input signal; and a transistor-transistor logic circuit operatively connected between said voltage divider network and ground and to said voltage level shifting means, said transistor-transistor logic circuit being adapted for providing the gating signal to the electron multiplication means.

18. An apparatus as set forth in claim 17 comprising first and second current amplifiers operatively connected between said voltage level shifting means and said transistor-transistor logic circuit.

* * * * *